US005217113A

United States Patent [19]

Kobayashi

[11] Patent Number: 5,217,113

[45] Date of Patent: Jun. 8, 1993

[54] GOLF BAG WITH TRANSPARENT PANEL

[75] Inventor: Masashi Kobayashi, Chiba, Japan

[73] Assignee: Maruman Golf Kabushikikaisha, Tokyo, Japan

[21] Appl. No.: 839,077

[22] Filed: Feb. 24, 1992

Related U.S. Application Data

[63] Continuation of Ser. No. 564,241, Aug. 8, 1990, abandoned.

[30] Foreign Application Priority Data

Aug. 9, 1989 [JP] Japan ..... 1-92976

[51] Int. Cl.[5] ..... A63B 55/00

[52] U.S. Cl. ..... 206/315.3; 206/45.31; 206/315.4

[58] Field of Search ..... 206/45.31-45.34, 206/315.3-315.8; 273/32 E; 220/662; 229/162

[56] References Cited

U.S. PATENT DOCUMENTS

| | | | |
|---|---|---|---|
| 1,306,083 | 6/1919 | Smith | 150/1.5 |
| 1,700,734 | 2/1929 | Brandt | 206/315.3 |
| 1,915,889 | 6/1933 | Johnson | 206/315.3 |
| 2,631,232 | 6/1954 | Womack | 206/315.4 |
| 2,704,563 | 3/1955 | Henrich | 206/315.4 |
| 2,867,257 | 1/1959 | Cart | 150/1.5 |
| 2,985,212 | 5/1961 | Dozier | 150/52 |
| 3,314,532 | 4/1967 | Henry | 206/45.31 |
| 3,316,951 | 5/1967 | Jacobson | 206/315.3 |
| 3,620,363 | 11/1971 | Donnithorne | 206/45.15 |
| 3,707,279 | 12/1972 | Kaiser | 206/315.4 |
| 3,720,197 | 3/1973 | Schroth | 126/270 |
| 4,022,261 | 5/1977 | Russell | 150/129 |
| 4,316,868 | 2/1982 | Esposito | 264/171 |
| 4,319,616 | 3/1982 | Light | 150/1.5 C |
| 4,573,111 | 2/1986 | Herst et al. | 362/337 |
| 4,621,670 | 11/1986 | Yuen | 150/55 |
| 4,673,082 | 6/1987 | Hemme | 206/315.6 |
| 4,953,768 | 9/1990 | Muse | 206/315.3 |

FOREIGN PATENT DOCUMENTS 614827 1/1949 United Kingdom .

*Primary Examiner*—Steven N. Meyers
*Assistant Examiner*—Thomas P. Hilliard
*Attorney, Agent, or Firm*—Armstrong, Westerman, Hattori, McLeland & Naughton

[57] ABSTRACT

A golf bag includes a transparent panel portion through which the inside of the golf bag is visible. Preferably, the golf bag is constructed of a bag main body having a side panel and defining a top opening, with a bottom panel attached to a bottom part of the bag main body and a top frame portion attached to the top opening. The transparent panel portion is formed in at least a part of the side panel.

12 Claims, 3 Drawing Sheets

GOLF BAG WITH TRANSPARENT PANEL

This application is a continuation of application Ser. No. 564,241 filed Aug. 8, 1990, now abandoned.

BACKGROUND OF THE INVENTION

1) Field of the Invention

The present invention relates to a golf bag, and more specifically to a golf bag having a transparent panel portion which can prevent confinement of moisture in the golf bag, in other words, can protect clubs from rusting and can facilitate removing and returning of the clubs from the golf bag. The term "transparent" as used herein should be interpreted in a broad sense so that it embraces not only "transparent" itself but also similar words such as "translucent" or "see-through" as long as objects of the present invention to be described subsequently can be achieved.

2) Description of the Related Art

Conventional golf bags are basically constructed of a bag main body, a bottom attached to a bottom part of the bag main body, and a top frame portion attached to an upper part of the bag main body.

A golf bag of the above sort, especially the bag main body is made of a material which does not permit transmittance of light, so that the inside of the bag is not visible through the bag main body. Upon removing a club from the golf bag or returning one to the golf bag, there is the tendency for the club to be forcedly handled because the inside is not visible through the bag main portion, it is not possible to see any obstruction by other golf clubs or their shafts. This is inconvenient and, in some instances, can even result in breakage of the club. When a golf bag of the above sort is used on a rainy day, it is difficult to dry the bag because sunlight cannot penetrate the inside of the bag when the bag is being dried. If the inside of the bag is not dried sufficiently, clubs may rust due to the moisture inside the bag.

SUMMARY OF THE INVENTION

An object of the present invention is to provide a golf bag which can avoid confinement of moisture; in other words, can protect clubs from rusting and can also facilitate the removal or return of clubs; in other words, can protect clubs from damage or breakage.

In one aspect of the present invention, there is thus provided a golf bag which comprises a transparent panel portion through which the inside of said golf bag is visible. Preferably, the golf bag comprises a bag main body having a side panel and a bottom part and defining a top opening, a bottom attached to the bottom part and a top frame portion attached to the top opening. The transparent panel portion is formed in at least a part of the side panel.

Owing to the provision of the transparent panel portion through which the inside of the golf bag is visible, the following advantageous effects have been brought about.

(i) Sunlight can penetrate effectively into the golf bag through the transparent panel portion so that moisture inside the golf bag can be reduced. As a result, metallic parts of clubs, such as heads and shafts, can be protected from rusting (rust preventive effect). Further, the reduced moisture can avoid the occurrence of mold inside the bag. The invention also makes much easier the drying of the bag interior after playing on a rainy day.

(ii) The penetration of sunlight through the transparent panel portion and makes the inside of the bag brighter. This facilitates the removal and return of clubs and can protect the clubs from breakage or damage during such removal and return.

(iii) As an additional benefit, colored grips and shafts can be seen through the transparent panel portion. This can add an attractive splash of color to the sporting environment.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
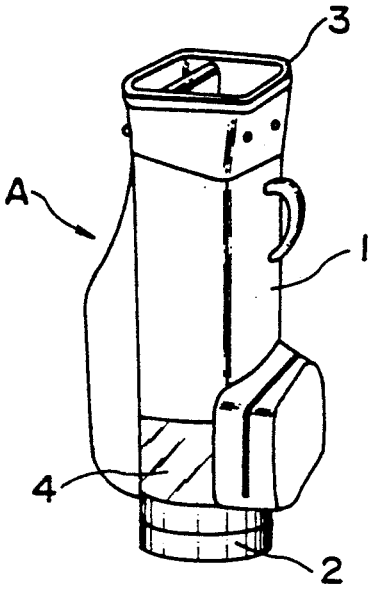
FIG. 1 is a perspective view of a golf bag according to a first embodiment of the present invention.

Referring first to FIG. 1, a golf bag according to a first embodiment of the present invention is constructed of a bag main body 1, a bottom 2 attached to a bottom part of the bag main body 1, and a top frame portion 3 attached to a top opening of the bag main body 1. FIG. 1 also shows pockets, a handle, club partitions, hooks for the attachment of a hood, etc.

Figure 2:
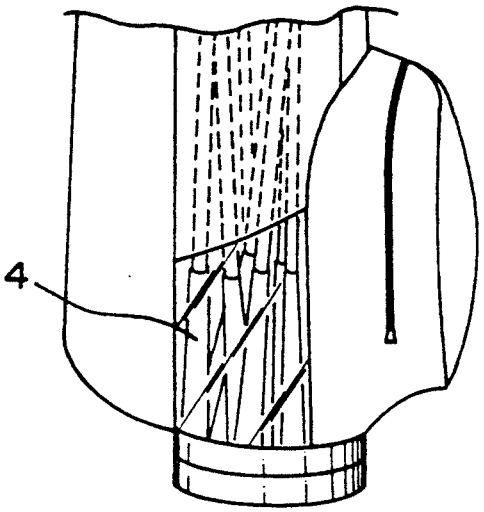
FIG. 2 is a fragmentary perspective view of the golf bag of FIG. 1, showing a transparent panel portion on an enlarged scale.

The principal feature of the present invention resides in a transparent panel portion 4 provided in a lower part of the bag main body 1. The lower part including the transparent panel portion 4 is depicted on an enlarged scale in FIG. 2. The transparent panel portion 4 can be formed with a synthetic resin material having excellent transparency and weatherability such as polyvinyl chloride resin over a desired area at a desired location in the lower part of the bag main body 1. The transparent panel portion 4 can also be formed with a material having excellent strength, for example, with a coarse woven fabric coated with a synthetic resin having superb transparency such as polyvinyl chloride resin. As is depicted in FIG. 2, the inside of the bag is visible through the transparent panel portion 4 so that the grips and shafts of clubs can be seen.

Needless to say, the transparent panel portion 1 may be formed wholly or partly as a closable window portion or an opening in the present invention. The closable window portion may conveniently zippered.

Since the inside of the bag can be seen through the transparent panel portion 4 in this embodiment as described above, it is possible to observe how the golf club shafts are stacked in the bag. It is therefore possible to rearrange them for easier removal and return. In addition, the transparent panel portion 4 is made of a transparent material, whereby sunlight is allowed to efficiently transmit therethrough. As a result, the moisture inside the bag can be reduced, thereby making it possible to achieve efficient drying. Where the transparent panel portion 4 is provided as a closable window portion, the efficiency of drying can be improved provided that the window portion is kept open during the drying.

Figure 3:
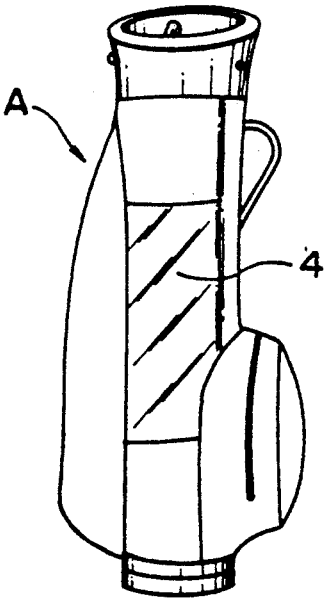
FIG. 3 is a perspective view of a golf bag according to a second embodiment of the present invention.

A second embodiment of the present invention is illustrated in FIG. 3, in which a transparent panel portion 4 is formed in an intermediary part of the bag main body 1. Since the transparent panel portion 4 is located at the intermediary part, all shafts can be seen therethrough. These days, grips and shafts are colored. In addition to the above advantageous effect, this embodiment makes it possible to see such colorful grips and shafts through the transparent panel portion 4. This provides the opportunity to bring the attraction of more color to the golfing environment.

Figure 4:
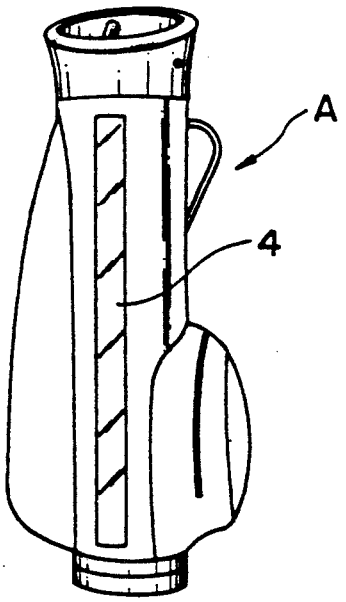
FIG. 4 is a perspective view of a golf bag according to a third embodiment of the present invention.

A third embodiment of the present invention is depicted in FIG. 4, in which a transparent panel portion 4 is formed as a band extending from an upper part of the bag main body 1 to a lower part thereof. The transparent panel portion 4 extends from the upper part of the bag main body 1 to the lower part thereof in this embodiment, so that the inside of the golf bag is fully illuminated. As a result, clubs can be easily removed and returned. The transparent panel portion 4 is also effective for the prevention of confinement of moisture.

Figure 5:
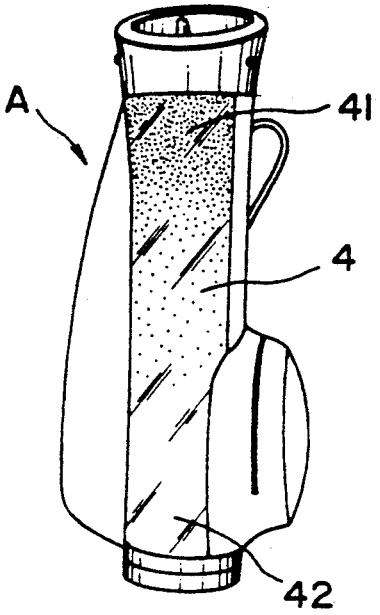
FIG. 5 is a perspective view of a golf bag according to a fourth embodiment of the present invention.

FIG. 5 illustrate a fourth embodiment of the present invention. As is depicted in FIG. 5, the bag main body 1 is made of polyvinyl chloride resin so that the bag main body 1 is formed wholly as a transparent panel portion 1. It is a characteristic feature of the present embodiment that the transmittance of the transparent panel portion 4, namely, the transmittance of the entire bag main body 1 gradually increases from an upper part (41) to a lower part (42). Accordingly, the upper part (41) looks like obscure or translucent glass. As a method for varying the transmittance of light, it is possible to use, for example, a method in which one or more of various fillers or bubbles are contained in polyvinyl chloride resin. This embodiment has the additional effect that the design of the bag can be diversified.

Figure 6:
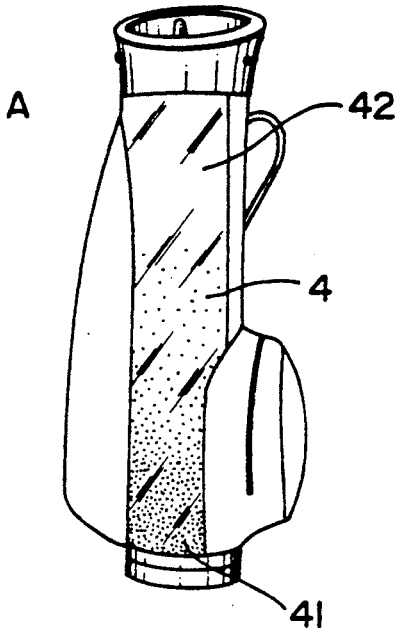
FIG. 6 shows a modification of the golf bag of FIG. 5.

FIG. 6 shows a modification of the fourth embodiment of FIG. 5. The transmittance of light gradually decreases from the upper part (42) to the lower part (41).

Figure 7:
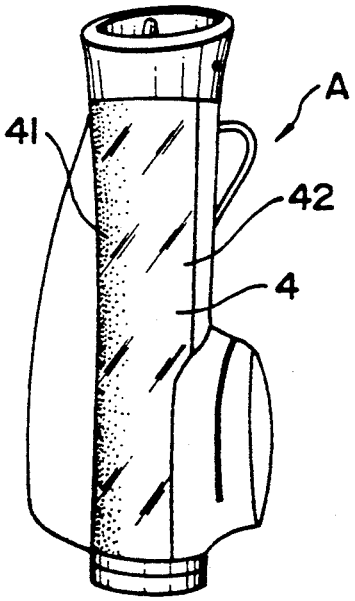
FIG. 7 illustrates another modification of the golf bag of FIG. 5.

FIG. 7 depicts another modification of the fourth embodiment of FIG. 5, in which the transmittance varies from high-transmittance part 42 to low-transmittance part 41 in the angular direction of the bag main body 1.

Figure 8:
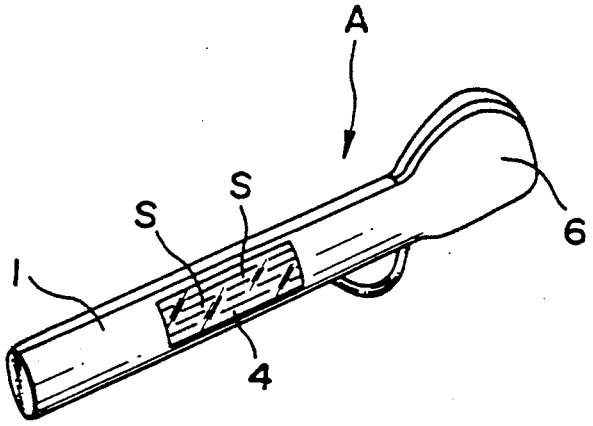
FIG. 8 is a perspective view of a golf bag according to a fifth embodiment of the present invention, in which clubs are contained.
Figure 9:
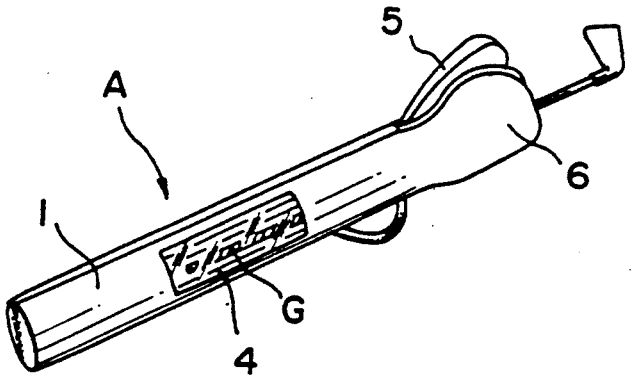
FIG. 9 is a perspective view of the golf bag of FIG. 8, from which one of the clubs is being removed.

A fifth embodiment of the present invention is shown in FIGS. 8–9. As is readily understood from these drawings, a golf bag A is a portable bag which is constructed of a bag main body 1 and a bag top 6 having a hood 5. A transparent panel portion 4 is formed in the bag main body 1. FIG. 8 shows the bag with clubs received therein, so that the arrangement of the shafts S of the clubs is visible through the transparent panel portion 4. FIG. 8 illustrates the state in which the bag top 6 is opened and one of the clubs is being removed therefrom, so that the grip G of the club is visible through the transparent panel portion 4. This embodiment can bring about similar advantageous effects as the second embodiment of FIG. 3.

Having now fully described the invention, it will be apparent to one of ordinary skill in the art that many changes and modifications can be made thereto without departing from the spirit or scope of the invention as set forth herein. For example, an umbrella sheath can be included. A shoulder strap can be added to facilitate the carriage of the golf bag and at the same time to leave golfers' both hands free. Full-length resin-made tubes can be provided for better protection of clubs.

What is claimed is:

1. A golf bag comprising:

a bag main body having a side panel and a top opening, said bag main body further includes an inner surface directly facing an inner portion enclosed by said bag main body and an outer surface directly facing outside said bag main body, said inner portion receiving golf clubs;

a bottom panel attached to a bottom portion of said bag main body;

a top frame portion attached to a periphery forming said top opening; and a pocket portion attached to said bag main body, wherein said bag main body includes a transparent panel portion formed therein to thereby permit direct viewing of said golf clubs through said transparent panel portion when said golf clubs are received within said inner portion enclosed by said bag main body, wherein said transparent panel portion extends from an upper part of said bag main body to a lower part of said bag main body with the transparency of said transparent panel portion varying gradually in one direction, and wherein the transparency of said transparent panel portion gradually decreases from said upper part of said bag main body to said lower part of said bag main body.

2. A golf bag comprising:

a bag main body having a side panel and a top opening, said bag main body further includes an inner surface directly facing an inner portion enclosed by said bag main body and an outer surface directly facing outside said bag main body, said inner portion receiving golf clubs;

a bottom panel attached to a bottom portion of said bag main body;

a top frame portion attached to a periphery forming said top opening; and a pocket portion attached to said bag main body, wherein said bag main body includes a transparent panel portion formed therein to thereby permit direct viewing of said golf clubs through said transparent panel portion when said golf clubs are received within said inner portion enclosed by said bag main body, wherein said transparent panel portion extends from an upper part of said bag main body to a lower part of said bag main body with the transparency of said transparent panel portion varying gradually in one direction, and wherein the transparency of said transparent panel portion gradually increases from said upper part of said bag main body to said lower part of said bag main body.

3. The golf bag of claim 2, wherein said transparent panel portion is formed in a lower part of said bag main body.

4. The golf bag of claim 2, wherein said transparent panel portion is formed at an intermediate part of said bag main body.

5. The golf bag of claim 2, wherein said transparent panel portion is formed as a band extending from an upper part of said bag main body to a lower part of said bag main body.

6. The golf bag of claim 2, wherein said transparent panel portion is formed as an openable window portion.

7. The golf bag of claim 6, wherein said window portion is made of a transparent synthetic resin.

8. The golf bag of claim 2, wherein said transparent panel portion is formed as an opening.

9. The golf bag of claim 2, wherein said transparent panel portion is composed of sections of different transparencies.

10. The golf bag of claim 2, wherein said transparent panel portion is formed over the entire periphery of said bag main body and the transparency of said transparent panel portion varies in an angular direction.

11. The golf bag of claim 2, wherein said golf bag comprises a bag main body and a bag top portion having a hood portion, and said transparent panel portion is formed at at least a part of a side panel of said bag main body.

12. The golf bag of claim 2, wherein said transparent panel portion is formed in at least a part of said side panel.

* * * * *